US005749665A

United States Patent [19]

Kato et al.

[11] Patent Number: 5,749,665

[45] Date of Patent: May 12, 1998

[54] KNOCK-TYPE LIQUID APPLICATOR

[75] Inventors: Naoki Kato, Ishioka; Masayuki Kawasaki, Soka, both of Japan

[73] Assignee: Pentel Kabushiki Kaisha, Japan

[21] Appl. No.: 500,882

[22] PCT Filed: Nov. 29, 1994

[86] PCT No.: PCT/JP94/01998

§ 371 Date: Jul. 20, 1995

§ 102(e) Date: Jul. 20, 1995

[87] PCT Pub. No.: WO95/15265

PCT Pub. Date: Jun. 8, 1995

[30] Foreign Application Priority Data

| | | | |
|---|---|---|---|
| Nov. 30, 1993 | [JP] | Japan | 5-068943 U |
| Jan. 31, 1994 | [JP] | Japan | 6-027424 |
| Jan. 31, 1994 | [JP] | Japan | 6-027432 |
| Jan. 31, 1994 | [JP] | Japan | 6-087751 |
| May 31, 1994 | [JP] | Japan | 6-140984 |

[51] Int. Cl.[6] ..... B43K 5/18; B43K 5/00; F04B 43/00

[52] U.S. Cl. ..... 401/264; 401/206; 401/177; 417/472

[58] Field of Search ..... 401/264, 206, 401/205, 196, 176, 177, 111, 153, 152; 222/206, 207, 209, 212; 417/472, 437, 413.1, 394, 395

[56] References Cited

U.S. PATENT DOCUMENTS

| | | | |
|---|---|---|---|
| 2,774,518 | 12/1956 | Greene | 417/437 |
| 3,281,887 | 11/1966 | Raffe | 401/205 |
| 4,480,940 | 11/1984 | Woodruff | 401/206 |
| 4,496,258 | 1/1985 | Tanaka et al. | 401/206 |
| 5,439,143 | 8/1995 | Brown et al. | 222/212 X |
| 5,454,658 | 10/1995 | Kato | 401/205 |

FOREIGN PATENT DOCUMENTS

| | | | |
|---|---|---|---|
| 125632 | 10/1976 | Japan . | |
| 55114 | 3/1977 | Japan . | |
| 57-121581 | 7/1982 | Japan | 401/206 |
| 56681 | 5/1991 | Japan . | |
| 406024195 | 2/1994 | Japan | 401/206 |
| 406127187 | 5/1994 | Japan | 401/206 |
| Wo 86/05144 | 9/1986 | WIPO | 401/206 |

*Primary Examiner*—D. Neal Muir
*Attorney, Agent, or Firm*—Adams & Wilks

[57] ABSTRACT

An applicator includes a valve comprising a valve seat and a valve disc to cut off the outflow of a coating solution storage chamber, and disposed between the coating solution storage chamber and an application member at the front end portion of an applicator main body to supply the coating solution retained by a capillary force to an article to be coated, and such that the sealed state by the valve seat and the valve disc is released and the coating solution is allowed to flow out from the coating solution storage chamber when the deformable wall portion is deformed by the pressing force applied to reduce the volume of the coating solution storage chamber. A coating solution absorber retaining the coating solution by capillary force and supplying the coating solution to the article to be coated is at the rear portion of the application member, and an air passage communicating with the outside of the applicator main body is extended to the back of the coating solution absorber. A deformable wall portion comprises a front large disc portion, a rear small disc portion and a cylindrical wall portion for connecting these disc portions. Accordingly, the coating solution flowing out from the coating solution storage chamber upon opening of the value can be temporarily stored in and be supplied to the application member by applying a limited quantity of solution dripping off from the application member without leaving blurred traces.

4 Claims, 4 Drawing Sheets

KNOCK-TYPE LIQUID APPLICATOR

TECHNICAL FIELD

This invention relates to an applicator for applying a suitable coating solution such as ink for writing instruments, an eye liner solution, a nail color solution, coloring materials, handwriting correction solution, adhesives and other various writing solutions and cosmetic solutions to a suitable member to be coated such as paper, a plastic film, glass, and metals. More particularly, the present invention relates to an applicator, or a kind of so-called "knock type valve structure applicator", which includes a valve comprising a valve seat and a valve disc normally in close contact with each other in such a manner as to cut off the outflow of a coating solution from a coating solution storage chamber and disposed between the coating solution storage chamber having a deformable wall capable of restoring its original shape and an application member so disposed at the front end portion of an applicator main body as to supply the coating solution retained by a capillary force to an article to be coated, and is designed so that the sealed state by the valve seat and the valve disc is released and the coating solution is allowed to flow out from the coating solution storage chamber when the deformable wall portion undergoes deformation by the pressing force applied to the deformable wall portion in such a manner as to reduce the volume of the coating solution storage chamber. Incidentally, among knock valve applicators, some have the structure wherein the volume change of the liquid storage chamber at the time of opening of the valve is practically negligible, but the applicator of the kind described above has the advantage that pressurization of the coating solution resulting from the deformation of the deformable wall portion to reduce the volume of the coating solution storage chamber can be used to promote the outflow of the coating solution from the liquid storage chamber. Therefore, the applicator is useful not only for applying the coating solution using dyes as coloring materials but also the coating solution using pigments as the coloring materials. The coating solution using the pigments can be effectively utilized for applying the solution to a non-liquid-absorbing surface of glass, metals, plastics or white boards by utilizing non-dyeability to the to-be-coated article, but has generally a higher viscosity than ordinary water-soluble dye ink such as fountain pen ink due to additives such as a fixation improving agent of pigment to the to-be-coated article and a dispersion stabilizer of the pigments in the solution. In other words, unless positively pressurized, the coating solution does not flow out smoothly in some cases from the coating solution storage chamber even when the valve is open.

BACKGROUND ART

An example of the applicator of the kind described above is disclosed in Japanese Utility Model Publication No. 55114/1982. The deformable wall portion is disposed as a contractile bellows portion at the rear end of the coating solution storage chamber and the valve disc is extended rearward to the inner wall side of this bellows portion. When the outer wall of the bellows portion is pushed forward to allow the coating solution to flow out, it is temporarily stored in the empty chamber, and this coating solution so stored is gradually consumed by the application member.

In this prior art device, the pushing pressure of the deformable wall portion not only elevates the internal pressure of the coating solution storage chamber but also invites the positive advance of the valve disc with respect to the valve seat. Accordingly, this device has the advantage that the valve can be opened without elevating the internal pressure of the coating solution storage chamber beyond a necessary level, but involves the following problems yet to be solved.

The first problem is the structure wherein the coating solution flowing out from the coating solution storage chamber due to opening of the valve is stored in an empty chamber. This structure is directed to supplying the coating solution to the application member in a quantity corresponding to the consumption quantity by the application member. In practice, however, the coating solution is likely to drip from the application member. Needless to say, this problem can be avoided by reducing the capacity of the empty chamber. However, even when a limited quantity of the coating solution is applied, a blurred trace of coating is likely to occur.

Another problem is that the deformable wall portion is secured by the contractile bellows portion. This arrangement deteriorates stability of the coating solution outflow property by valve opening. For, the bellows portion undergoes contraction by the application of the push force and extension by the application of the tensile force. If this tensile force is continuously applied, the bellows portion will remain extended, though it has restoration to a certain extent. Moreover, the bellows portion is essentially likely to extend with the passage of time due to the residual strain at the time of forming. Once the bellows portion is extended, the outflow quantity of the coating solution by valve opening becomes more excessive than the initial set quantity, and this arrangement provides another cause of the drip of the coating solution from the application member. To prevent free extension of such a bellows portion, a rigid outer casing, or the like, as described in the prior art reference is necessary. Even when extension of the bellows portion with the passage of time can be prevented by such a complicated structure, the dust clamped by the inner wall portion of the bellows portion unavoidably impedes the contraction operation of the bellows portion. Entry of the dust into the coating solution storage chamber is naturally eliminated as much as possible, but is not completely. In the case of a coating solution such as pigment ink which is likely to generate sediments, the solidified matters of the coating solution components render the same trouble as the dust described above. The existence of such impediments reduces the outflow quantity of the coating solution by valve opening to a smaller level than the initial set quantity, contrary to the case of the extension of the bellows portion, and coating of even a limited quantity of the coating solution generates blurred trace of the coating solution in the same way as described above.

In short, the prior art device described above involves the problems yet to be solved from the aspect of storage of the coating solution after it is allowed to flow out by opening the valve, from the aspect of deformation of the deformable wall for opening the valve, and from the aspect of the supply of the coating solution from the coating solution storage chamber by valve opening, by temporarily storing a sufficient quantity and supplying it to the application member, without generating blurred trace by a small quantity of the coating solution dripping off from the application member.

DISCLOSURE OF THE INVENTION

In view of the problems described above, the present invention aims at providing an applicator which temporarily stores a sufficient quantity of a coating solution flowing out from a coating solution storage chamber due to opening of a valve and which can supply the coating solution to the application member without generating blurred trace of coating even when a limited quantity of the coating solution dripping from an application member is applied.

To accomplish this object, the present invention first employs the structure wherein a coating solution absorber capable of retaining the coating solution by the capillary force and supplying the coating solution so retained to the application member is provided at the back of the application member in such a manner as to continue the application member. For, it is by all means necessary to eliminate the problem of the absence of the ink retaining capacity of the empty chamber in the prior art device described in the prior art reference. Nonetheless, the requirement cannot be satisfied entirely by merely disposing the coating solution absorber inside an application member main body. As a prerequisite, air must be charged into the coating solution storage chamber in such a manner as to substitute the coating solution flowing out from this storage chamber. In this point, the capillary passages of the coating solution absorber can retain the coating solution and at the same time, can serve as air passages. Even though the air passages can thus be secured, the coating solution retained by the coating solution absorber cannot be supplied smoothly to the application member if the coating solution absorber is arbitrarily disposed. Therefore, the coating solution absorber must be disposed in such a manner as to secure an air passage which is separate from the capillary passages of the coating solution absorber and which extends to the back of the absorber.

The present invention includes additional constructions on the basis of the construction described above as the fundamental construction. The minor constructions correspond to the construction wherein the coating solution is stored after it is allowed to flow out by opening the valve and the construction wherein the deformable wall portion undergoes deformation so as to open the valve, respectively, and these two constructions may be mutually independent of or may be combined with each other. According to one of these constructions, a cylindrical coating solution passage is so formed in front of the valve as to continue from the valve and the wall portion of the open end of this coating solution passage is covered with the coating solution absorber. The coating solution flowing out due to opening of the valve is not allowed to immediately overflow the air passage but the coating solution retained by the coating solution absorber is caused to flow back to the coating solution storage chamber by utilizing the drop of the internal pressure of the coating solution storage chamber when the deformable wall portion is allowed to restore by releasing the pressing force if the quantity of the coating solution retained by the coating solution absorber increases. In this way, even when the valve is repeatedly opened, the increase of the quantity of the coating solution retained by the coating solution absorber is restricted beyond a certain level and thus leakage of the coating solution resulting from its outflow beyond the coating solution retaining capacity of the coating solution absorber can be prevented. According to the other construction, the deformable wall portion comprises a front large disc portion, a rear small disc portion and a cylindrical wall portion for connecting these disc portions. This deformable wall portion receives the force of deformation to exhibit a deforming feature in such a manner that the front portion of the cylindrical wall portion connecting with the front large disc portion expands with respect to a valve opening direction force and the rear portion of the cylindrical wall portion connecting with the rear small disc portion contracts. It exhibits a great resistance to deformation against the force in the opposite direction because such a force compulsively extends the cylindrical wall portion. Even if the dust or the solidified matters of the coating solution components exist, the deformable wall portion does not undergo deformation in such a manner as to clamp these matters from the aspect of the shape. Accordingly, it can sufficiently solve the problems with the deformable wall portion of the prior art device described in the afore-mentioned reference.

BEST MODE FOR CARRYING OUT THE INVENTION

Figure 1:
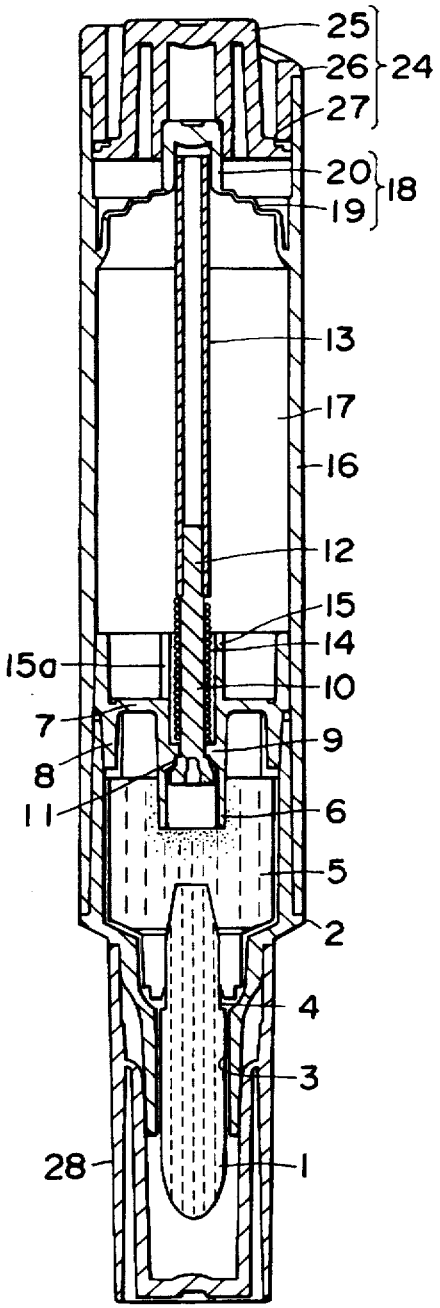
FIG. 1 is a longitudinal sectional view showing an applicator according to an embodiment of the present invention.

In FIG. 1, the rear portion (on the upper side in the drawing) of an application member 1 has a smaller diameter than the front portion (lower side in the drawing). Further, the rear end portion is somewhat tapered. The application member shown in the drawing is produced by bundling fibers such as polyethylene terephthalate, for example, solidifying the bundle by an adhesive in such a manner that the outer peripheral portion is somewhat harder than the inner peripheral portion, or by fusing partially the fibers with one another to obtain an elongated member, cutting the elongated member into a predetermined length, and shaping the front and rear portions of each member so cut. In other words, the application member is shaped into an ordinary, so-called "fiber nib", but it may be a porous urethane or may be a structure consisting of a plurality of members such as a pen tip portion of a ball-point pen or a small tube type writing instrument.

Figure 2:
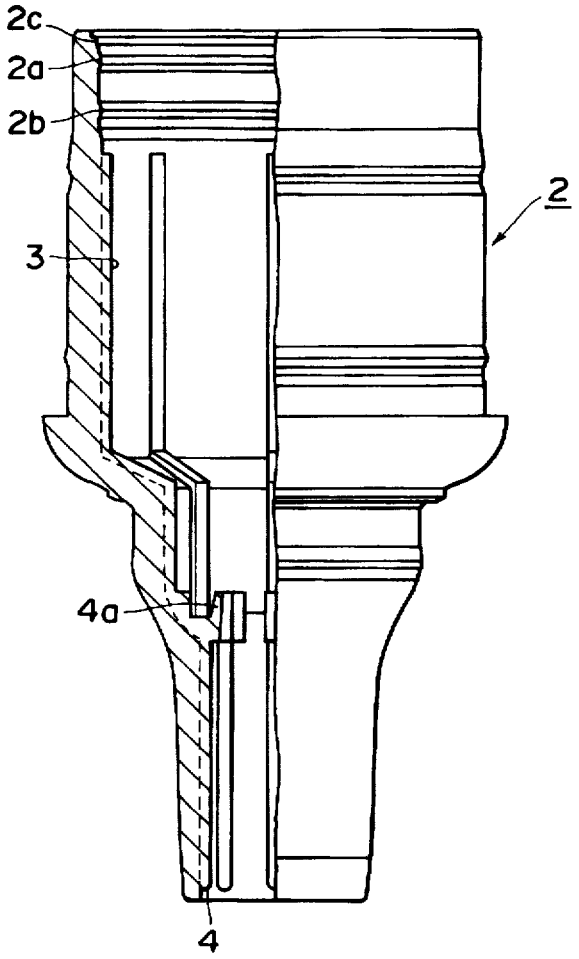
FIG. 2 is an enlarged longitudinal semi-sectional view of a front shaft shown in FIG. 1.

A front shaft 2 fixes this application member 1 under the protruding state. A through-hole 3 of the front shaft 2 has a small diameter at the front portion and a large diameter at the rear portion. The front portion of the application member 1 is positioned in this small diameter hole, and its rear portion extends to the large diameter hole. It is a plurality of axial ribs 4 formed on the inner wall of the through-hole 3 that position the application member 1. As shown also in FIG. 2, these ribs 4 extend from near the front end of the small diameter hole beyond the half of the large diameter hole, and have a protuberance 4*a* at the intermediate portion thereof which protrudes rearward near the rear end of the small diameter hole. The front end of this protuberance 4*a* functions as an engagement step portion with respect to the application member 1. The protuberance 4a and the inner wall portion of the rib 4 in front of the protuberance 4a serve as contact walls to the application member 1. A space communicating with the outside is defined between the outer wall of the application member 1 and the inner wall of the front shaft 2 and at the same time, a push-in force for preventing fall-off of the application member 1 is secured. Incidentally, the rear end of the protuberance 4a is shaped preferably into a check portion which prevents fall-off of the application member 1, which is likely to fall off, by catching. The rear end of the protuberance 4a shown in the drawing faces the center of the through-hole 3 to some extents.

The large diameter hole at the rear portion of the through-hole 3 functions as a storage portion of a coating solution absorber 5. A suitable continuous porous material may be selected for the coating solution absorber 5 in accordance with the kind of the application member 1 so that it can retain the coating solution by the capillary force and can supply it so retained to the application member 1. For example, a crimp fiber such as an acrylic resin is bundled at a suitable density, and its outer peripheral portion is covered with a film such as cellophane by using an adhesive or the fibers of the outer peripheral portion are mutually fused to the extent such that the shape becomes stable, so as to obtain an elongated member. The elongated member so obtained is then cut into a predetermined length. The application member 1 is fitted into the front end portion of the this coating solution absorber 5 so that the taper-like rear end portion of the application member 1 can be buried. A space is defined between the ribs 4 formed on the inner wall of the through-hole 3 and the inner wall of the front shaft 2 from the outer peripheral wall of the coating solution absorber 5 to the peripheral edge portion of its front end. This space communicates with the afore-mentioned space on the outer wall portion of the application member 1 through a greater space portion and serves as an air passage. Though such an air passage can be secured by combining an application member or coating solution absorber having a polygonal cross-section with a front shaft having a round through-hole, axial extension of the ribs 4 is one of reliable means for securing easily the air passage.

Figure 3:
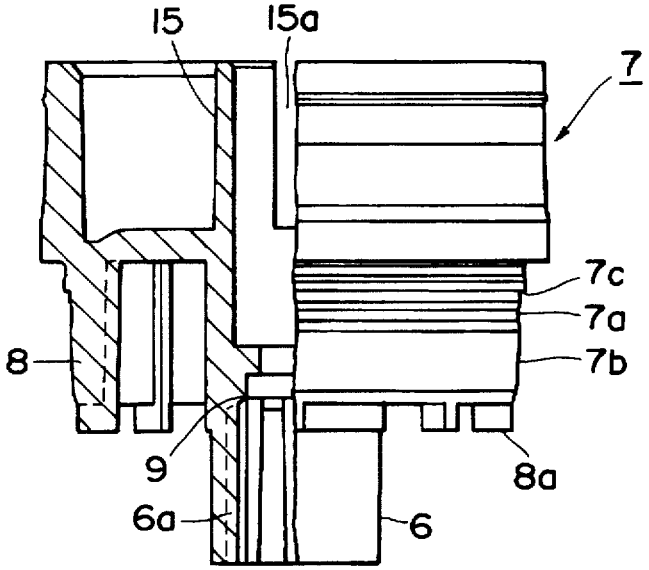
FIG. 3 is an enlarged longitudinal semi-sectional view of the front portion of a valve body shown in FIG. 1.

A cover 7 having an inner cylinder portion 6, which protrudes forward, is fitted into the large diameter hole at the rear portion of the through-hole 3 of the front shaft 2 from the back of the coating solution absorber 5. The peripheral rib 2a formed on the inner wall of the front shaft 2 shown in FIG. 2 serves as a fitting portion to a peripheral recess portion 7a formed on the outer wall of the cover 7 shown in FIG. 3. Similarly, the peripheral rib 2b in front of the peripheral rib 2a of the front shaft 2 serves as a liquid-tight retention portion to the taper-like outer wall portion 7b of the cover 7, and the inner step portion 2c of the front shaft 2 serves as a positioning butt portion to an outer step portion 7c of the cover 7. Fitting portions for the later-appearing rear shaft 10 are formed on these front shaft 2 and cover 7 in view of liquid-tightness, but such fitting and eventually, coupling of components, can be designed originally and suitably by ultrasonic fusing technology. Therefore, the explanation will be hereinafter omitted.

The cover 7 is fitted into the rear end side of the coating solution absorber 5 in such a manner as to bury the front portion of the inner cylinder portion 6, and clamps the coating solution absorber 5 by the front end protuberance 8a of the outer cylinder portion 8 (see FIG. 3) in cooperation with the ribs 4 of the front shaft 2. Here, a plurality of front end protuberances 8a are radially disposed, and each of them has a certain length so that the coating solution member 5 can be reliably clamped even when it has certain variance of shape. When the coating solution absorber 5 consists of the fiber bundle as described already, for example, shape stability equivalent to that of an ordinary synthetic resin injection molded article cannot be provided so easily even when the outer peripheral portion of the fiber bundle is covered with the film of when the fibers of the outer peripheral portion are mutually fused to the extent such that the shape can be stabilized. This front end protuberance 8a serves as means for extending rearward the communication space as the afore-mentioned air passage to the back of the coating solution absorber 5. Needless to say, it is possible to suitably form a transverse hole at the small diameter hole portion of the through-hole 3 of the front shaft 2 without positioning the open portion of the communication space at the front end of the front shaft 2, and a suitable hole may be formed so as to extend the communication space to the back of the coating solution absorber 5. Incidentally, the front end portion of the coating solution absorber 5 (lower side in the drawing) is depicted as a non-vertical wall, but the drawing typically illustrates deformation due to clamping, in order to represent that the coating solution absorber 5 need not be intentionally disposed in an arrangement which causes shake of this member 5. Therefore, the present invention naturally avoids choking of the communication space due to excessive deformation.

Next, the inner cylinder portion 6 will be explained. This inner cylinder portion 6 represents an example of "a cylindrical coating solution passage (the wall portion of the open end of which is covered with the coating solution absorber)".

The method of covering the wall of the open end portion of the coating solution passage by the coating solution absorber in the present invention may be such that the planar wall portion of the open end of the coating solution passage comes into contact with a part of the planar wall surface of the coating solution absorber. In order to increase the coating solution outflow quantity per opening of a valve, however, the quantity of the coating solution which is moved back to the coating solution storage chamber when the deformed wall returns to its original shape must be increased, too. To accomplish this object, a greater quantity must exist near the open end portion of the coating solution passage of the coating solution absorber. From this aspect, it is advantageous if the coating solution absorber has a recess and can allow the existence of the coating solution not only in front of the open end of the coating solution passage but also at the back thereof when the front portion of the coating solution passage is fitted into this recess. Moreover, to prevent the mixture of air as much as possible when the coating solution moves back, the coating solution preferably moves from the surrounding portion of the open end of the coating solution passage of the coating solution absorber towards the portion near the open end with movement of the coating solution. Once the air passage communicating with the coating solution passage is formed in such a manner as to communicate with the capillary passage of the coating solution absorber, intrusion of air into the coating solution storage chamber becomes more predominant than the backward movement of the coating solution. To insure smooth movement of the coating solution inside the coating solution absorber, it is possible, for example, to reduce the diameter of the capillary passage of the coating solution absorber to apply wettability improvement treatment so as to improve the coating solution retaining capacity near the open end portion of the coating solution passage to a higher level than that at the surrounding portions.

The arrangement wherein the front portion of the inner cylinder portion 6 of the cover 7 is fitted into the rear end side of the coating solution absorber 5 under the buried state is an example of such arrangements. When the coating solution absorber 5 consists of the fiber bundle as described above, the coating solution absorber 5 undergoes deformation in such a manner as to reduce the gaps between the fibers. If the absorber 5 is deformable even when it does not comprise the fiber bundle, the diameter of the capillary passage can be easily reduced by deformation. If the coating solution absorber 5 has a large deformable range, the degree of deformation becomes smaller at positions remote from the position at which the deforming force is applied. In other words, even though the diameters of the capillary passage are individually different, the coating solution absorber 5 has, as a whole, a high coating solution retaining capacity near the open end portion of the inner cylinder portion 6, and this coating solution retaining capacity becomes smaller at positions away from this position. Incidentally, dots applied to a part of the coating solution absorber 5 in FIG. 1 represents the existence of this deformation. However, the dots do not mean that only the dotted portion undergoes deformation. As a matter of fact, deformation develops due to insertion of the application member 1 for forming the recess, too. If the length of the coating solution absorber 5 is small at the portion where it is sandwiched by these recesses, the feed rate of the coating solution from the coating solution absorber 5 to the application member 1 can be advantageously improved, but this merit is not relevant to the matter described above. Hence, dots are not applied.

Preferably, the coating solution passage has a cylindrical shape having a cross-section capable of forming a liquid film such as a straw for drinking juice or milk. Water put into a test tube immediately falls when the test tube is turned upside down. However, the liquid in the straw held at one of the ends thereof in one's mouth does not fall so easily even when the other open end of the straw is directed downward unless he blows out air or he shakes compulsively the straw or the volume of internal air is increased by heating. When a small quantity of remaining juice or milk is under the mixed state with air inside the straw, they do not freely substitute one another even though the gravitational force acts upon them. In other words, it is preferred that the coating solution passage is not big to such an extent that the coating solution easily drops off along the inner wall. Its volume is preferably smaller than the outflow quantity of the coating solution per opening of the valve. Even when the coating solution passage has a large volume, the coating solution can be absorbed by the coating solution absorber if a part of the absorber can be expected to be positioned inside the coating solution passage, for example, but reliability is low in this case. Therefore, the inner cylinder portion 6 of the cover 7 has a sufficiently small inner diameter and a sufficiently small length so as to reduce the volume, though it has a plurality of ribs 6*a* on the inner wall thereof (see FIG. 3).

Figure 4:
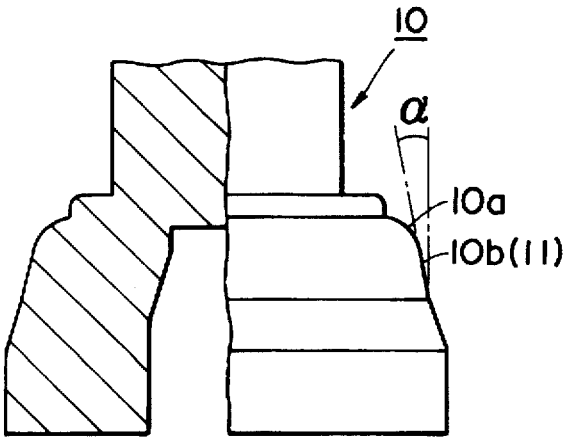
FIG. 4 is an enlarged longitudinal semi-sectional view of the front portion of a valve body shown in FIG. 1.

The ribs 6*a* of the inner wall of the inner cylinder portion 6 restrict rocking of the valve disc 10 which comes into contact with, and comes out contact from, the valve seat 9 of the cover 7. The valve portion 11 of the valve disc 10 is the contact portion with the valve seat 9. When the valve portion 11 which has once come off from the valve seat 9 comes again into contact with the valve seat 9, it is ideal if the contact state again returns to the original contact state from the valve opening/closing operation, particularly from the valve closing operation. Rocking of the valve disc 10 is prevented so as to attain this state as much as possible. As shown in FIG. 4, the valve disc 10 includes a wall portion 10*a* the front swell portion of which is rounded, and a taper wall portion 10*b* gently continuing from this wall portion 10*a*. A part of this taper wall portion 10*b* is used as the valve portion 11, and the taper angle of the taper wall portion 10*b* is as small as about 10° for the same reason as described above. Incidentally, when the valve disc 10 is made of a synthetic resin such as polypropylene, the wall portion of the taper wall portion 10*b* serving as the valve portion 11 might somewhat undergo deformation upon contact with the valve seat portion 9 immediately after assembly if the cover 7 is made of the same polypropylene but having a different grade. Even in such a case, the valve portion 11 stably comes into contact with, and leaves, the valve seat 9 with flexibility.

The valve disc 10 protrudes rearward far off the cover 7 beyond the valve seat 9. The small diameter portion 12 is fitted and fixed by the cylinder body 13 at an intermediate portion in view of the assembling factor, and the cylinder body 13 is positioned at the back of the valve disc 10. However, the cylinder body 13 can be integrated with the valve disc 10 if suitable components are integrated or produced as separate members. In other words, the cylinder body 13 is a catcher member for a spring member 14 for flexibly bringing the valve portion 11 of the valve disc 10 into contact with the valve seat 9 of the cover 7 and is also an extension member for obtaining the advantage that the valve can be opened without excessively elevating the internal pressure of the coating solution storage chamber. If this advantage is neglected or when a spring member having a large length is used as the spring member 14, the catcher portion for the spring member 14 can be formed by changing the shape of the rear end portion of the valve disc 10. Incidentally, in the device shown in the drawing, the front end of the cylinder body 13 is used for the catcher portion for the spring member 14, but a bidirectional protruding portion due to push deformation may be suitably formed on the peripheral wall portion of the cylinder body 13 like the member formed in a straight tubular ink cylinder of an oily ball-point pen having a retractile pen tip. The cylinder portion 15 protruding rearward in the cover 7 shown in the drawing functions as a guide for the spring member 14 so as to restrict rocking of the rear portion of the valve disc 10 which extends in a large length, but the cover 7 defines the front wall portion of the coating solution storage chamber and is equipped with the slits 15*a* for preventing the coating solution from remaining without being consumed by this cylinder portion 15. Further, the spring member 14 shown in the drawing defines a gap with the cylinder portion 15, but in view of the assembling factor, the structure is preferably employed wherein the spring member 14 receives some push force from the cylinder portion 15. This is the case, for example, where all the components described above ranging from the application member 1 prepare one assembly as a whole. In other words, in the embodiment shown in the drawing, the valve disc 10 is fitted from the front to the cover 7, the spring member 14 and the cylinder body 13 are fitted from back to the cover 7, the cylinder body 13 is then fixed to the valve disc 10 and in this way, a cover set is prepared. On the other hand, the application member 1 is fitted from the front to the front shaft 2, the coating solution absorber 5 is fitted from the back, and then the front shaft 2 and the cover set are fitted to each other, thereby providing the front shaft set as a whole. At this time, if an arrangement is so made that the spring member 14 receives some push force from the cylinder portion 15, the spring member 14 is fitted in advance to the cover 7 lest it easily falls off during the assembly of the cover set, and the cylinder body 13 can be fitted to the assembly. Needless to say, when the spring member 14 comprises an ordinary coil spring, expansion of the diameter at the time of contraction must be taken into consideration.

The front shaft set described above is fitted from the front into the rear shaft 16. The inside of the front shaft functions as the coating solution storage chamber 17. The wall at the back of the coating solution storage chamber 17 is a movable wall portion 18 integrated with the rear shaft 16. The movable wall portion 18 can be separated from the rear shaft 16 in the same way as in the case where the cover 7 forming the front wall portion of the coating solution storage chamber 16 may be separated from the rear shaft 16, but there is no need to intentionally increase the number of components and to invite the increase of the cost of production.

Figure 5:
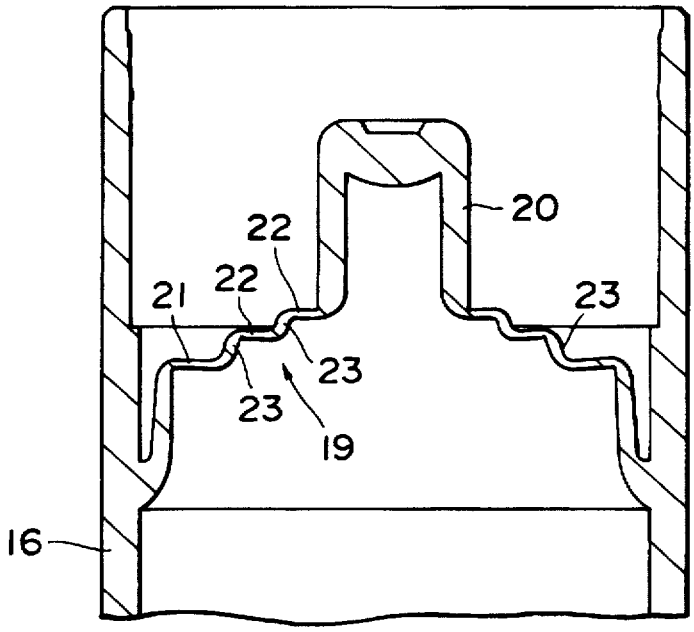
FIG. 5 is an enlarged sectional view of principal portions and is useful for explaining a deformable wall portion shown in FIG. 1.
Figure 6:
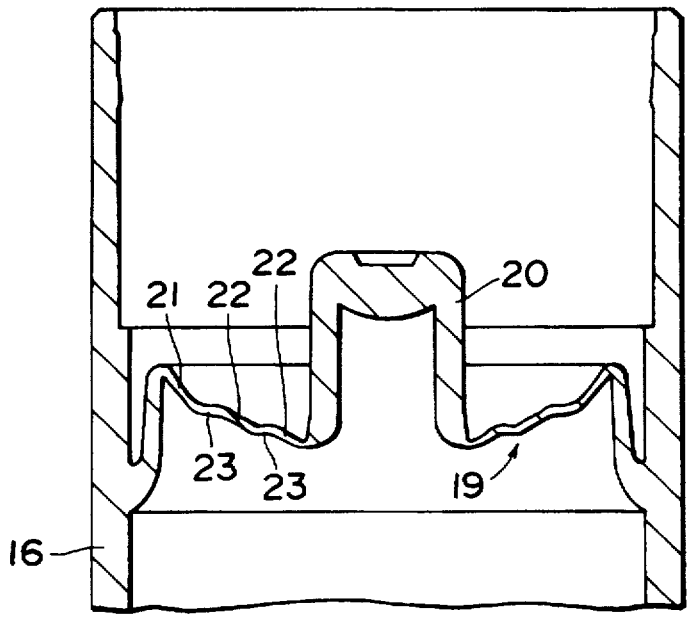
FIG. 6 is an enlarged longitudinal sectional view of the deformable wall portion shown in FIG. 1 and is useful for explaining one state at the time of its deformation.

The movable wall portion 18 comprises a deformable wall portion 19 and a non-deformable wall portion 20 at the center. The deformable wall portion 19 expands in the skirt form with respect to the non-deformable wall portion 20, and comprises a front large disc portion 21, a rear small disc portion 22 and a cylindrical wall portion 23 for connecting these discs 21, 22. Incidentally, FIG. 5 shows two rear small disc portions, and the drawing represents that a suitable number of small disc portions may further be disposed at the back of the small disc portions. However, these small disc portions, too , are connected by the cylindrical wall portion 23. Both disc portions 21, 22 form a substantially flat surface, respectively. The term "substantial flat surface" means that the surface may be a complete or incomplete flat surface. As a matter of fact, the large disc portion 21 shown in FIG. 5 is somewhat recessed at the center when only this disc portion is considered. The cylindrical disc portion 23 is substantially vertical to these disc portions 21, 22. The term "substantial" in this case means that the cylindrical disc portion can preferably bend back due to the pressure force, though this property is associated with the flatness of the disc portions 21, 22. The reason why the cylindrical disc portion 23 shown in the drawing has a front portion having a greater diameter than the drawing has a front portion is because this warping property is taken into consideration. As can be seen from the example shown in FIG. 6, if this warping property is satisfied, the volume change of the coating solution storage chamber 17 can be increased, and the outflow quantity of the coating solution per valve opening operation can be increased. Further, the thickness is preferably greater if this warping property can be satisfied. From the aspect of the shape, the deformable wall portion 19 has the advantage that it can be shaped by injection molding, but if a reduced thickness portion is formed over a broad range, the deformable portion become more likely to be broken during molding. The materials that can be used for injection molding are various, such as polyethylene, polyacetal, polyester and nylon, but materials not easily permeating the coating solution are preferable, and polypropylene is an example of such materials.

The non-deformable wall portion 20 is disposed as a pressing wall portion for imparting the pressing force. It can be fundamentally omitted because the small disc portion at the rear portion may form a center bottomed portion. In such a case, however, the pressing force is imparted to the deformable wall portion itself, and breakage is more likely to occur. If such a wall portion is disposed, it is advantageous to employ the structure wherein the wall portion has the shape of a bottomed cylinder as shown in the drawing, the rear end portion of the cylinder body 13 forming the rear portion of the valve disc 10 is fitted into the inner hole portion and rocking of the valve disc 10 is so restricted. Incidentally, in the embodiment shown in the drawing, a small gap is defined between the non-deformable wall portion 20 and the cylinder body 13 so that initial deformation of the movable wall portion 18 has some play with respect to the pressing force for opening the valve.

To secure the region of the deformation wall portion 19, it is not preferred to increase so much the region of the non-deformable wall portion 20. In some cases, the non-deformable wall portion eventually becomes an extremely small region positioned at the center of the movable wall portion 18, though depending on the overall size of the applicator. It would be extremely good to apply the force by a finger, for example, to such a non-deformable wall portion 19. Therefore, a separate knock body 25 is fitted to the outer wall of the non-deformable wall portion 20 shown in the drawing.

The knock body 25 shown in the drawing is prepared as an integral component connected to a tail plug 26 fitted to an extension portion, which is integrally molded with the rear shaft 16, at a connecting portion 27. It constitutes an integral tail plug member 24 as an erroneous knock prevention member till delivery to a user, or up to an arbitrary point of time during assembly by a manufacturer, that is, until it is broken and separated at the connecting portion 27. Preferably, design should be made so that a small gap is defined at the connecting portion after separation. Incidentally, in the embodiment shown in the drawing, the rear end of the extended cylinder portion of the rear shaft 16, in which the knock body 25 is fitted movably, does not allow the rear end of the knock body 25 to hardly protrude. This is to prevent unnecessary opening of the valve due to the unrequired application of the pressure during transportation inside a bag, for example.

Figure 7:
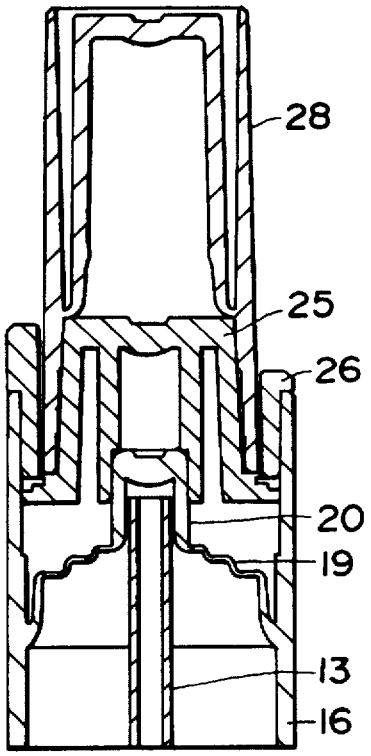
FIG. 7 is a longitudinal sectional view of principal portion and is useful for explaining the use of a cap shown in FIG. 1.

The applicator of this embodiment includes the applicator main body comprising the members described above, and a cap 28 is removably fitted to the main body. Generally, the cap can be fitted to the rear part of the main body, too, in view of the possible loss of the cap during use, and the cap 28 of this embodiment employs the same structure. As shown in FIG. 7, knocking is possible even when the cap 28 is fitted to the knock body 25. In other words, when the push force is applied to the cap fitted to the rear end of the application member main body or to the rear end of the knock body 25, the movable wall portion 18 moves forth, and the valve disc 10 advances against the force of the spring member 14 and opens the valve. Incidentally, the coating solution can be charged into the coating solution storage chamber 17 in the following ways. For example, the coating solution is charged in advance in the coating solution storage chamber 17 and the front shaft set described already is then fitted as a whole. Alternatively, only the application member 1 among the front shaft set is left unfitted, the predetermined quantity of the coating solution is then charged by a syringe in such a manner as to penetrate through the coating solution absorber 5 from the front end of the front shaft 2 under the valve open state, and thereafter the application member 1 is inserted.

Figure 8:
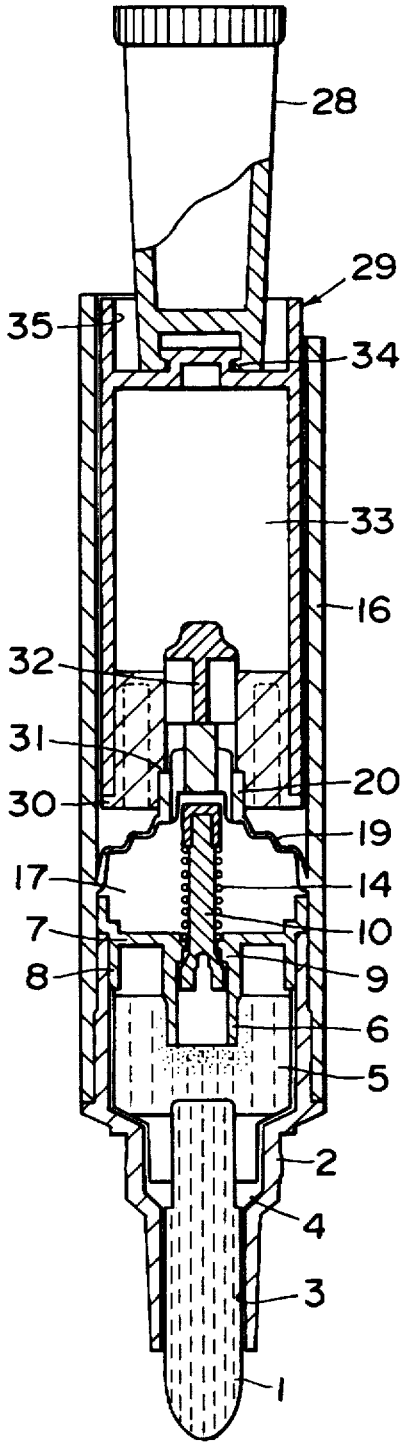
FIG. 8 is a longitudinal sectional view of an applicator according to another embodiment of the present invention.

Next, another embodiment will be explained with reference to FIG. 8. In the drawing, like reference numerals are used to identify constituent members having fundamentally the same function, but this embodiment includes the deformable wall portion 19 which is disposed at a considerably front position. Moreover, the coating solution passage is disposed in the non-deformable wall portion 20, and a cartridge 29 is removably fitted to this non-deformable wall portion 20. Here, it is positioned by a step portion 31 disposed in an inner wall of a plug body 30 in front of the cartridge 29. A seal member 32, which is pushed by the rear end of the non-deformable wall portion 20 under the state shown in the drawing, is disposed in the inner hole of the plug body 30. This seal member 32 allows the coating solution storage chamber 33 inside the cartridge 29 to communicate with the coating solution storage chamber 17 in front of the deformable wall portion 19 through the coating solution passage of the non-deformable wall portion 20 described above. Incidentally, because the seal member 32 is positioned more forward so as to secure the sealing property in the inner hole portion of the plug body 30 before fitting of the cartridge 29, the liquid inside the cartridge 29 does not leak out. Further, the shape of the cap 28 is different from that of the foregoing embodiment. In other words, it has a fitting portion 34 for the cartridge 29 so as to remove the cartridge 29. When the cap 28 is pulled under the state shown in the drawing, the cartridge can be taken off, and then fitting at the fitting portion 34 is released. In the ordinary case where the valve is opened, etc, the cap 28 is fitted in the reverse direction to the inner wall of the rear recess portion 35 of the cartridge 29. When the cap 28 is fitted without the intention of removing the cartridge 29, some bending force may be applied to the cap 28, and fitting of the fitting portion 34 can be preferentially released.

Various changes and modifications can be also made, through not shown in the drawings. For example, the tail plug member 24 of the first embodiment is fitted to a separate exterior member, and in this way, the formation of the extended cylinder portion integral with the rear shaft 16 in the first embodiment can be omitted.

We claim:

1. A knock-type applicator comprising:

a main body having a first end and a second end;

a storage chamber located in the main body for storing a coating solution;

an application member having a first end and a second end for retaining by a capillary force a coating solution supplied from the storage chamber and supplying the coating solution to an article to be coated, the application member being mounted in and extending into the main body;

an absorbing member mounted in the main body for absorbing by a capillary force the coating solution and supplying the coating solution to the application member, the absorbing member having a first end, a second end, a first recess at the first end thereof connected to the second end of the application member, and a second recess at the second end thereof, the second end of the absorbing member being connected with and in fluid communication with the second end of the application member;

a valve disposed between the storage chamber and the absorbing member for directing the coating solution from the storage chamber to the absorbing member;

a first space defined between an outer periphery of the absorbing member and the main body;

a second space defined between an outer periphery of the application member and the main body, the second space opening to the outside of the main body and being in fluid communication with the first space; and an actuator for actuating the valve to direct the coating solution from the storage chamber to the absorbing member, the valve comprising a valve body connected to the actuator and movably mounted in the second recess at the second end of the absorbing member, and a cover member having a tubular portion disposed in the second recess, the tubular portion having a valve seat for engagement by the valve body, the actuator comprising a movable member having a pressing portion and a flexible portion integrally connecting the pressing portion and the main body so that the pressing portion is axially movable in the main body, the pressing portion being connected to the valve body, the flexible portion comprising a first disc portion, a second disc portion smaller than the first disc portion, and a cylindrical wall portion connecting the first and second disc portions to one another, the cylindrical wall portion having a thickness greater than a thickness of each of the first and second disc portions.

2. A knock-type applicator as claimed in claim 1; wherein the cylindrical wall portion has a first portion connected to the first disc portion, and a second portion connected to the second disc portion, the first portion having a diameter greater than the diameter of the second portion.

3. A knock-type applicator comprising:

a main body having a first end and a second end;

an application member mounted in and extending into the main body for supplying a coating solution to an article to be coated, the application member having a first end and a second end;

a storage chamber located in the main body for storing a coating solution;

an absorbing member having a first end and a second end and being mounted in the main body for absorbing the coating solution, the absorbing member being connected with and in fluid communication with the second end of the application member;

a valve for directing the coating solution from the storage chamber to the absorbing member; and an actuator for actuating the valve to direct the coating solution from the storage chamber to the absorbing member, the actuator having a pressing portion connected to the valve and a flexible portion integrally connecting the pressing portion and the main body so that the pressing portion is axially movable in the main body, the flexible portion comprising a first disc portion, a second disc portion smaller than the first disc portion, and a cylindrical wall portion connecting the first and second disc portions to one another, the cylindrical wall portion having a thickness greater than a thickness of each of the first and second disc portions.

4. A knock-type applicator as claimed in claim 3; wherein the cylindrical wall portion has a first portion connected to the first disc portion, and a second portion connected to the second disc portion, the first portion having a diameter greater than the diameter of the second portion.

* * * * *